US008145117B2

(12) United States Patent
Matsuno

(10) Patent No.: US 8,145,117 B2
(45) Date of Patent: Mar. 27, 2012

(54) IMAGE FORMING APPARATUS WITH SHEET DETECTION UNIT WHICH ACCURATELY DETECTS SHEET

(75) Inventor: Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 476 days.

(21) Appl. No.: 12/335,603

(22) Filed: Dec. 16, 2008

(65) Prior Publication Data

US 2009/0162080 A1 Jun. 25, 2009

(30) Foreign Application Priority Data

Dec. 20, 2007 (JP) ..... 2007-328320

(51) Int. Cl.
*G03G 15/00* (2006.01)
*B41J 29/00* (2006.01)

(52) U.S. Cl. ..... 399/405; 400/708

(58) Field of Classification Search ..... 400/708.1; 399/405

See application file for complete search history.

(56) References Cited

U.S. PATENT DOCUMENTS 4,814,825 A * 3/1989 Johdai et al. ..... 271/65
7,162,195 B2 * 1/2007 Matsuyama et al. ..... 399/404
7,280,775 B2 * 10/2007 Kubochi et al. ..... 399/33
2002/0051232 A1 * 5/2002 Hattori ..... 358/456
2002/0127022 A1 * 9/2002 Tanaka ..... 399/16

FOREIGN PATENT DOCUMENTS

JP 52-114034 U 2/1977
JP 1-108559 U 7/1989
JP 08-137168 5/1996
JP 2000-159390 A 6/2000
JP 2003076111 3/2003

OTHER PUBLICATIONS

Notification of Reasons for Refusal dispatched Jan. 24, 2012 in Japanese Patent Application No. 2007-328320 and English translation thereof.

* cited by examiner

*Primary Examiner* — Judy Nguyen
*Assistant Examiner* — Blake A Tankersley
(74) *Attorney, Agent, or Firm* — Banner & Witcoff, Ltd

(57) ABSTRACT

An image forming apparatus is provided. The image forming apparatus includes a fixing unit that is configured to fix a developing material on a sheet; a plurality of a pair of rollers that discharge the sheet conveyed from the fixing unit; and a sheet detection unit that detects the sheet conveyed from the fixing unit, the sheet detection unit comprising an actuator for detecting the sheet conveyed from the fixing unit, wherein the actuator of the sheet detection unit is disposed between the fixing unit and the plurality of the pair of the rollers on a conveyance path and is disposed within a width of one of the rollers when viewed from a sheet conveyance direction.

6 Claims, 10 Drawing Sheets

Prior Art

IMAGE FORMING APPARATUS WITH SHEET DETECTION UNIT WHICH ACCURATELY DETECTS SHEET

CROSS REFERENCE TO RELATED APPLICATION

The present application claims priority from Japanese Patent Application No. 2007-328320, which was filed on Dec. 20, 2007, the disclosure of which is herein incorporated by reference in its entirety.

TECHNICAL FIELD

Apparatuses and devices consistent with the present invention relate to an image forming apparatus, and more particularly to an image forming apparatus capable of detecting an ejected sheet with superior accuracy.

BACKGROUND

A sheet discharge sensor 4 has hitherto been provided in the vicinity of a pair of vertically-arranged discharge rollers 2, and the sensor is used for the purpose of detecting a trailing end of a sheet 1, and the like. FIG. 10A is a diagrammatic view of a related-art sheet detection mechanism, and FIG. 10B is a diagrammatic view of the sheet detection mechanism when viewed from the front in FIG. 10A. In the related art, when the sheet 1 is ejected from the front, the sheet 1 is conveyed, while deflected, under the influence of heat stemming from a heating roller 3; hence, there arises a problem of a decrease in the detection accuracy of the sheet discharge sensor.

Meanwhile, Japanese unexamined patent application publication No. JP-A-2003-76111 (Hereinafter, Patent Document 1) describes a related art image forming apparatus. In the related art image forming apparatus, when a toner pattern on a transfer belt is detected by means of a sensor, the sensor is disposed opposite the surface of a conveyor roller, thereby correcting surface waviness in the belt and performing detection. According to this configuration, it is possible to realize a stable detection of a toner pattern with superior accuracy.

SUMMARY

However, the discharge rollers 2 located downstream of the heating roller 3 discharge the sheet 1 while the sheet is nipped between the discharge rollers 2. Therefore, it is impossible to place the sensor opposite the rollers as described in Patent Document 1.

Accordingly, an object of the invention is to provide an image forming apparatus capable of well detecting a sheet.

According to an illustrative aspect of the present invention, there is provided an image forming apparatus comprising: a fixing unit that is configured to fix a developing material on a sheet; a plurality of a pair of rollers that discharge the sheet conveyed from the fixing unit; and a sheet detection unit that detects the sheet conveyed from the fixing unit, the sheet detection unit comprising an actuator for detecting the sheet conveyed from the fixing unit, wherein the actuator of the sheet detection unit is disposed between the fixing unit and the plurality of the pair of rollers on a conveyance path and is disposed within a width of one of the rollers when viewed from a sheet conveyance direction.

According to an another aspect of the present invention, an image forming apparatus comprising: a fixing roller for fixing a developing material on a sheet; a discharging roller that is disposed at a downstream side in a sheet conveyance direction than the fixing roller and is configured to discharge the sheet; and a sheet detection unit that comprises: a sensor unit that has a light-emission portion and a light receiving portion; and an actuator unit that has a shaft disposed between the fixing roller and the discharge roller, a projecting portion protruding from a first portion of the shaft, and a light-shielding portion protruding from a second portion opposite to the first portion in an axial direction of the shaft, wherein the projection portion is disposed between the fixing roller and the discharge roller and is disposed within a width of the discharge roller when viewed from the sheet conveyance direction, and wherein when the projection portion does not contact the sheet conveyed from the fixing roller, the light-shielding portion is located at a position between the light-emission portion and the light-shielding portion, and when the projection portion contacts the sheet conveyed from the fixing roller, the shaft rotates so that the light-shielding portion is located outside of the position.

BRIEF DESCRIPTION OF THE DRAWINGS

Illustrative aspects of the invention will be described in detail with reference to the following figures wherein.

DETAILED DESCRIPTION OF THE EXEMPLARY EMBODIMENTS OF THE PRESENT INVENTION

First Exemplary Embodiment

[Schematic Configuration of an Image Forming Apparatus]

Figure 1:
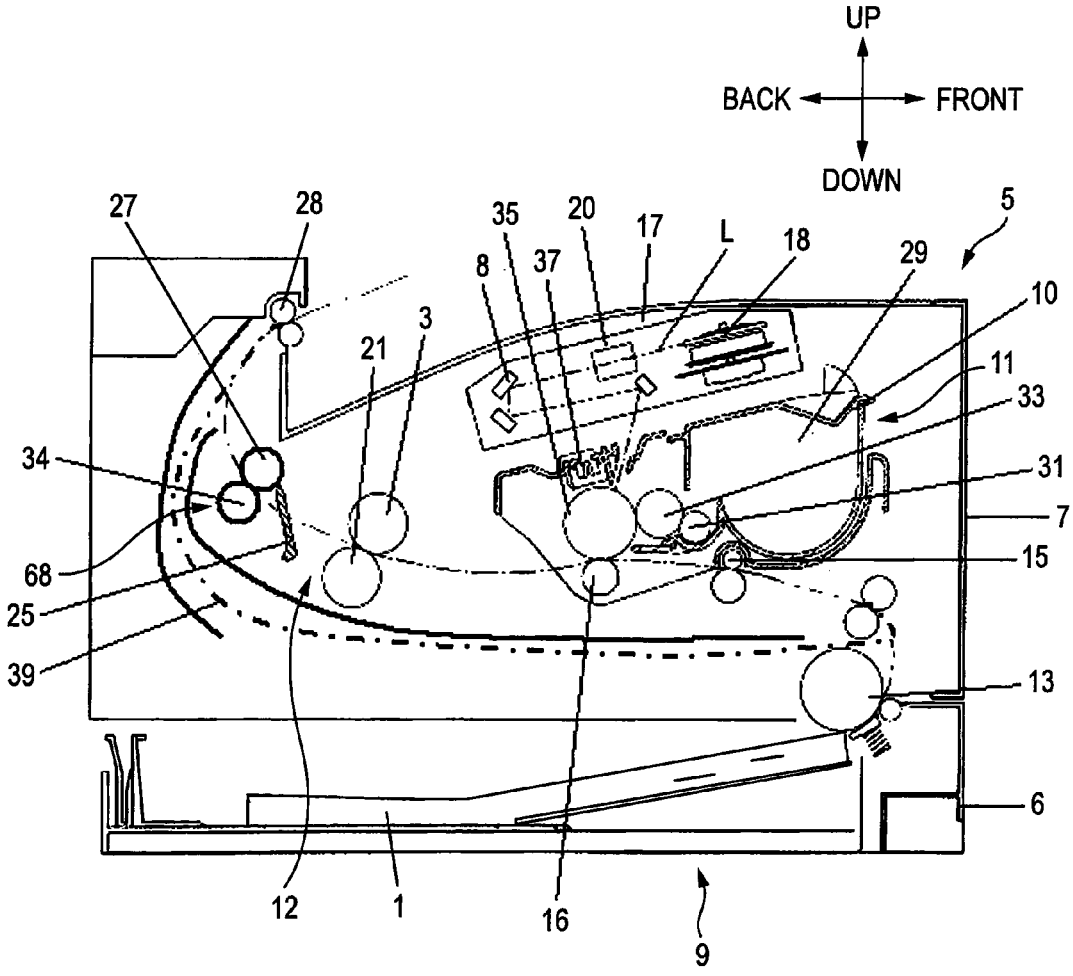
FIG. 1 is a view of the center cross section of a laser printer 5 of the present invention.

A first exemplary embodiment of the present invention is described in detail hereunder by reference to the drawings. FIG. 1 is a schematic view of the center cross section of a laser printer 5 serving as an image forming apparatus. The vertical direction and the front-and-back direction are defined below as shown in FIG. 1. The laser printer 5 has an essentially-box-shaped housing 7. The housing 7 has a sheet feeding section 9 that feeds sheets 1; an image forming section 11 that generates an image; a thermal fixing section 12 that fixes an image generated on the sheet 1; and the like.

The sheet feeding section 9 has a sheet feeding tray 6 to be removably attached; a sheet feeding roller 13 provided at an elevated position above the front end side of the sheet feeding tray 6; and a registration roller 15 disposed down stream of the sheet feeding roller 13 in the direction of conveyance of the sheet 1 (an upstream side in the direction of conveyance of the sheet 1 is hereinafter called simply "upstream," and a downstream side in the direction of conveyance of the sheet 1 is hereinafter called simply "downstream"). The sheet 1 fed from the sheet feeding tray 6 by means of the sheet feeding roller 13 is sent to the registration roller 15. The registration roller 15 is made up of a pair of rollers and delivers the sheet 1 to the image forming section 11 after having subjected the sheet to predetermined registration.

The image forming section 11 located in the center of the housing 7 has a process cartridge 10 and a scanner unit 17 serving as an exposure unit.

The scanner unit 17 is disposed at an upper area within the housing 7 and has a laser emission section (not shown), a polygon mirror 18 rotationally driven by a motor, a lens 20, a reflection mirror 8, and the like. As indicated by dotted lines, a laser beam L, which is emitted from the laser emission section and which is based on predetermined image data, is caused to sequentially pass the polygon mirror 18, the lens 20, and the reflection mirror 8 or to sequentially reflection on them, to thus be radiated, by means of a high-speed scan, onto the surface of a photosensitive element 35 serving as an image carrier of the process cartridge 10 to be described later.

The process cartridge 10 is disposed beneath the scanner unit 17 and configured so as to be removably attached to the housing 7. The process cartridge 10 has an electrifier 37, a supply roller 31, a developing roller 33, and a toner storage chamber 29 housing toner serving as a developing material, as well as being provided with a photosensitive element 35. Toner is carried on the surface of the developing roller 33 by means of rotation of the supply roller 31 and delivered to the photosensitive element 35 that generates an electrostatic latent image by means of the developing roller 33. The photosensitive element 35 is disposed so as to be able to rotate so as to oppose the developing roller 33. A main body of the photosensitive element is connected to a ground, and a surface of the same is formed from a positively-chargeable photosensitive layer made of polycarbonate, or the like.

After being uniformly electrified with a positive polarity by means of an electrifier 37 disposed above the photosensitive element 35 along with rotation of the photosensitive element 35, the surface of the photosensitive element 35 is exposed to a high-speed scan stemming from a laser beam L from the scanner unit 17, whereupon an electrostatic latent image based on the predetermined image data is generated. Subsequently, when the photosensitive element opposes the developing roller 33, the positively-electrified toner carried on the developing roller 33 is supplied to and selectively carried by the electrostatic latent image generated on the surface of the photosensitive element 35; namely, an area whose electric potential has decreased upon exposure to the laser beam L in the surface of the photosensitive element 35 uniformly charged with positive polarity, whereby the latent image is visualized and reversal development is achieved.

The transfer roller 16 is disposed opposite, beneath the photosensitive element 35 while supported by the housing 7 in a rotatable manner. In the transfer roller 16, a metal roller shaft is covered with a roller made of a conductive rubber material, and a predetermined transfer bias is applied to the photosensitive element 35. Therefore, the visible image formed from the toner carried on the photosensitive element 35 is transferred to the sheet 1 during the course of the sheet 1 passing between the photosensitive element 35 and the transfer roller 16 and transported to the thermal fixing section 12.

Figure 2:
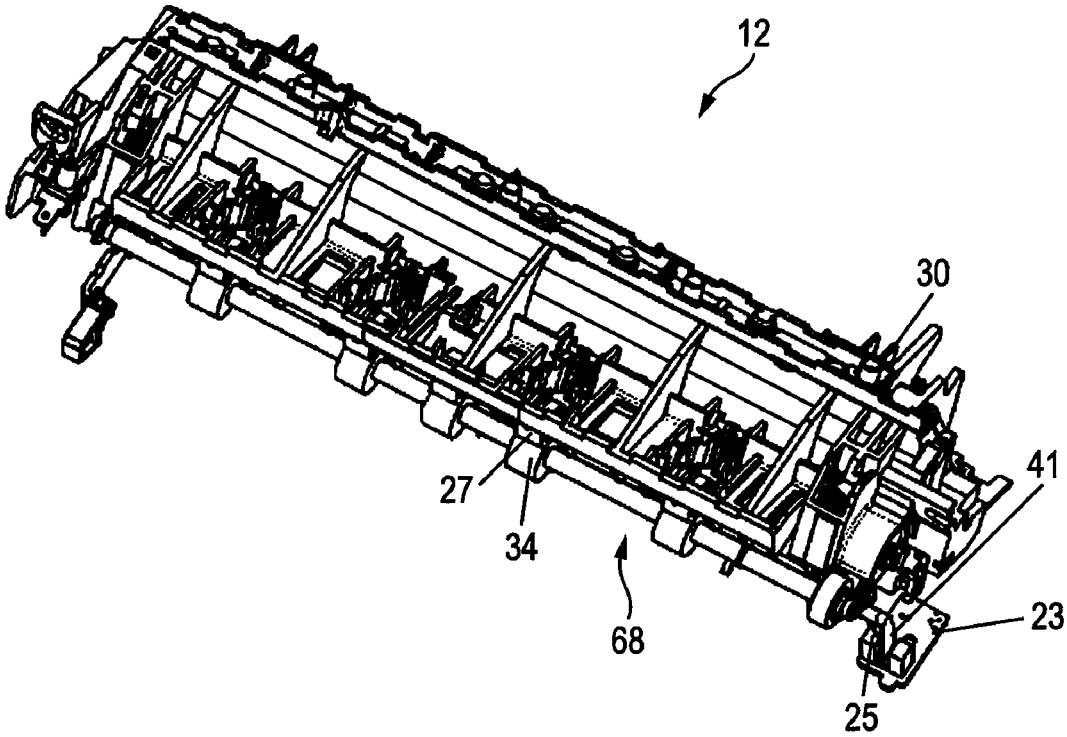
FIG. 2 is a perspective view of a thermal fixing section 12 of the laser printer 5.
Figure 3:
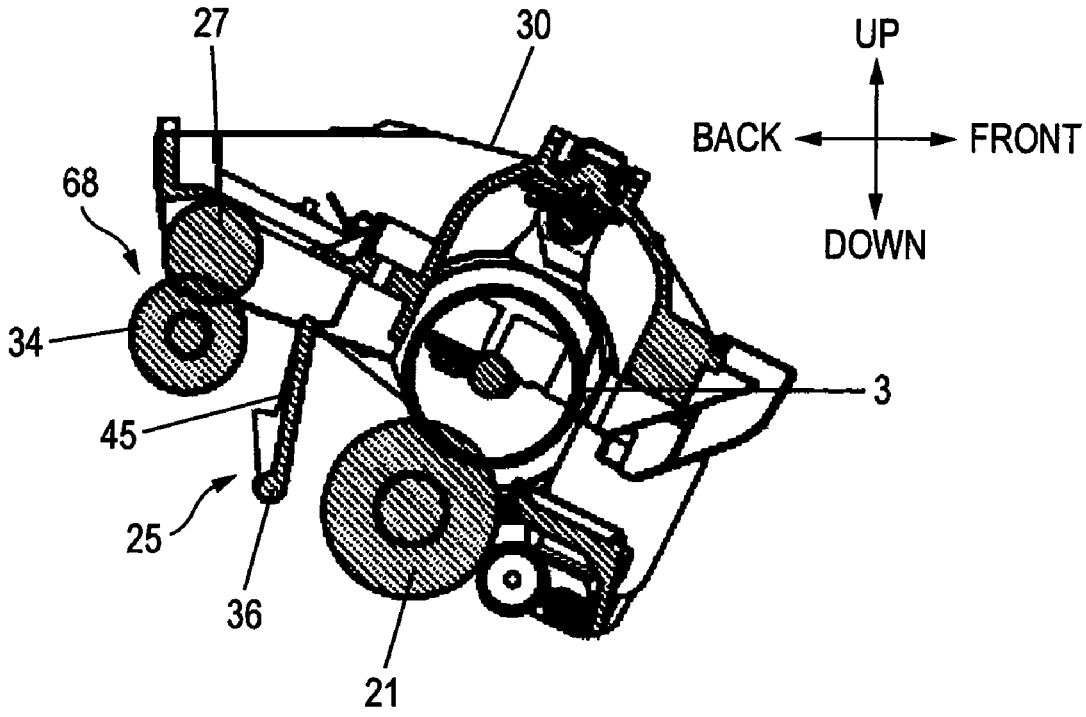
FIG. 3 is a center cross-sectional view of the thermal fixing section 12 shown in FIG. 2.

The thermal fixing section 12 is disposed downstream from the process cartridge 10. FIG. 2 is a perspective view of the thermal fixing section 12, and FIG. 3 is a center cross-sectional view of the thermal fixing section 12 shown in FIG. 2. The thermal fixing section 12 has a casing 30 fixed within the housing 7, and the casing 30 is made of an insulator. The heating roller 3 serving as a heating unit constituting a fixing unit of the present invention and a press roller 21 serving as a pressure unit are rotatably supported by the casing 30. A pair of vertically-arranged discharge rollers 68 constituting a discharge unit of the present invention are rotatably supported downstream from the heating roller 3 and the press roller 21. An actuator 25 that detects the sheet 1 ejected from a position between the heating roller 3 and the press roller 21 is supported by the casing 30.

The heating roller 3 has therein a metal heater (not shown). The press roller 21 is a roller at least whose surface is made of a cushioning material, rubber or the like. As a matter of course, the surface of the heating roller 3 may also be made of a cushioning material, and the surface of the press roller 21 may also be made of a hard material. The heating roller 3 is rotationally driven by a motor (not shown) provided in the housing 7. As a result of the heating roller 3 and the press roller 21 contacting each other in the vertical direction, the sheet 1 is conveyed while nipped between the rollers.

The toner transferred onto the sheet 1 by means of the process cartridge 10 is thermally fixed while the sheet 1 passes, in a nipped manner, between the heating roller 3 and the press roller 21. The heating roller 3 and the press roller 21 can also be substituted by heating and press units, such as endless belts.

The thermally-fixed sheet 1 is nipped by a discharge roller 68 located downstream and conveyed further in a downstream direction and discharged to the outside of the housing 7 by means of a pair of feed rollers 28 (see FIG. 1) located at an elevated position within the housing 7.

The present invention is not limited to the mechanism described in connection with the first exemplary embodiment and can undergo various modifications. For instance, a monochrome laser printer is mentioned in the first exemplary embodiment; however, a color laser printer, an LED printer, and the like, may also be adopted.

[Mechanism for Detecting Sheet to be Discharged]

Figure 4:
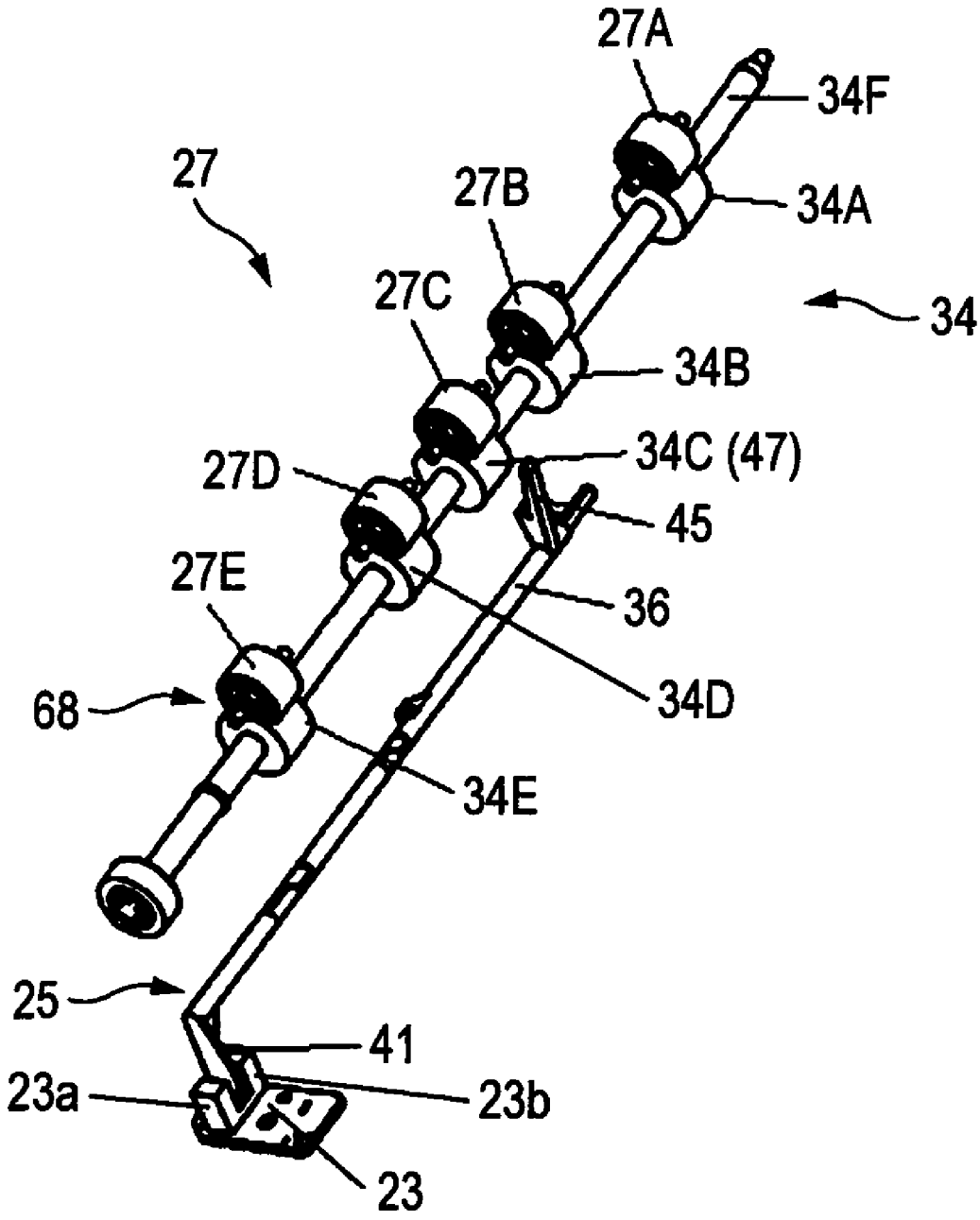
FIG. 4 is a perspective view of an actuator 25 and a discharge roller 68 shown in FIG. 2.

Next, a mechanism for detecting the sheet 1 discharged out of the thermal fixing section 12 will be described. FIG. 4 is a perspective view of the actuator 25 and the discharge roller 68 shown in FIG. 2. An upper discharge roller 27 constituting the discharge roller 68 is constituted of a roller 27A, a roller 27B, a roller 27C, a roller 27D, and a roller 27E. These rollers are rotatably supported by the casing 30 while spaced apart a predetermined interval from each other (see FIG. 2).

A roller 34A, a roller 34B, a roller 34C, a roller 34D, and a roller 34E are fixed at a predetermined interval to a rotary shaft 34F located parallel to a rotary shaft of the upper discharge roller 27. The rollers 34A, 34B, 34C, 34D, and 34E constitute a lower discharge roller 34 making up the discharge roller 68. The roller 34A is disposed opposite the roller 27A; the roller 34B is disposed opposite the roller 27B; the roller 34C is disposed opposite the roller 27C; the roller 34D is disposed opposite the roller 27D; and the roller 34E is disposed opposite the roller 27E. A rotary shaft 34F of the lower discharge roller 34 can be rotated by rotational driving action of an unillustrated motor disposed in the housing 7. The sheet 1 to be conveyed is nipped by the discharge roller 68 constituting the present invention and ejected downstream. Further, the lower discharge roller 34C that contacts the center of the sheet 1 that is centered and ejected constitutes a center roller 47 making up the present invention.

The actuator 25 is made up of a shaft section 36 that is located between the press roller 21 and the discharge roller 68 and that is positioned in parallel to the rotary shaft 34F of the lower discharge roller 34; a projecting section 45 vertically protruding from one end of the shaft section 36; and a light-shielding section 41 vertically protruding from the other end of the shaft section 36. The projecting section 45 of the actuator 25 protrudes to a position over a conveyance path for the sheet 1 between the fixing unit and the discharge roller 68 and within the width of the center roller 47.

The sensor section 23 is provided in the housing section 7 and arranged in such a way that the light-shielding section 41 of the actuator 25 is sandwiched between a light-emission portion 23*a* of the sensor section 23 and a light receiving portion 23*b* of the sensor section. That is, the sensor section 23 is divided into the light-emission portion 23*a* and the light-receiving portion 23*b*, and light is emitted from a light-emission side to a light-receiving side.

When the sheet 1 is not in contact with the projecting section 45 of the actuator 25 during transport of the sheet 1, the light-shielding section 41 of the actuator 25 is placed at a position where the light-shielding section 41 hinders the sensor section 23 from receiving light by means of a stopper member (not shown) that is forced at all times in a clockwise direction in FIG. 4 by means of a spring member (not shown) and that is provided on the casing 30. Further, a leading end of the projecting section 45 is fixed at this time to a location where the leading end protrudes to a position above the conveyance path.

When the leading end of the sheet 1 contacts the projecting section 45 of the actuator 25 as a result of the sheet 1 being fixed and ejected downstream, the actuator 25 is rotated in a counterclockwise direction in FIG. 4 in defiance of force of the spring member. At this time, the light-shielding section 41 of the actuator 25 that keeps hindering the sensor section 23 from receiving light is also rotated, to thus recede from the sensor section 23. Thereupon, the sensor section 23 can let light fall on the light-receiving portion (23*b*) from the light-emission portion (23*a*). Upon detection of receipt of light, the sensor section 23 detects conveyance of the sheet 1.

When a trailing end of the sheet 1 departs from the projecting section 45 of the actuator 25 as a result of the sheet 1 being conveyed downstream, the actuator 25 is released from the force stemming from the sheet 1; thence, the actuator is rotated counterclockwise in FIG. 4 by means of action of the spring member. At this time, the light-shielding section 41 of the actuator 25 is again returned to the position where the light-shielding section hinders the sensor section 23 from receiving light. The sensor section 23 detects ejection of the trailing end of the sheet 1 upon re-detection of hindrance to receipt of light. The actuator 25 and the sensor section 23 constitute a sheet detection unit of the present invention.

Figure 5A:
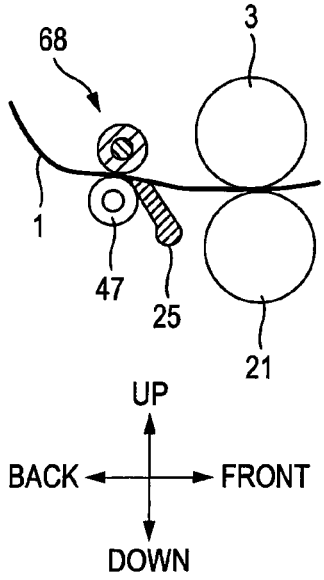
FIG. 5A is a center cross-sectional view of the thermal fixing section 12 in FIG. 2.
Figure 5B:
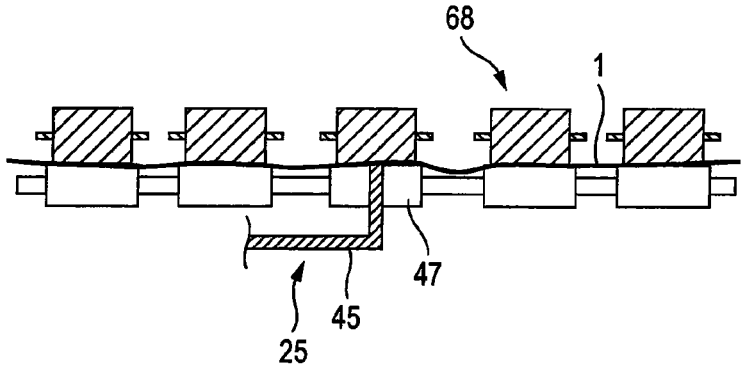
FIG. 5B is a schematic view showing the discharge roller 68 and the actuator 25 when viewed from the front in FIG. 5A.

The thus-fixed sheet 1 is conveyed to the discharge roller 68 while nipped. FIG. 5A is a center cross-sectional view of the thermal fixing section 12, and FIG. 5B is a schematic view showing the discharge roller 68 and the actuator 25 when viewed from the front in FIG. 5A. The drawings show that the sheet 1 is discharged rearwardly while nipped by the discharge roller 68.

In FIG. 5B, a deflection in the area of the sheet 1 nipped by the discharge roller 68 is corrected when compared with an un-nipped area. At this time, an area that the leading end of the projecting section 45 of the actuator 25 disposed in the width of the center roller 47 for discharging the sheet 1 contacts is an area of the sheet 1 whose deflection has been corrected. Consequently, the actuator 25 can detect the trailing end of the sheet 1 with high accuracy at a position on the sheet 1 where deflection is eliminated.

In the laser printer 5 configured as mentioned above, the sheet 1 conveyed from the sheet feeding section 9 to the image forming section 11 is imparted with the toner image generated on the photosensitive element 35 by means of transfer operation and then conveyed to the thermal fixing section 12. Subsequently, the toner image of the sheet 1 is thermally fixed in the thermal fixing section 12 and conveyed to the discharge roller 68. The sheet 1 conveyed to the downstream discharge roller 68 is conveyed while nipped between the upper roller 27 and the lower roller 34. At this time, the actuator 27 can detect the sheet 1 at the position where the deflection has been corrected by the discharge roller 68. Subsequently, the sheet 1 is ejected to the outside of the housing 7 by means of the downstream feed roller 28.

Second Exemplary Embodiment

[Sheet Detection Mechanism Having a Groove Formed in the Discharge Roller]

In the second exemplary embodiment, an exemplification in which a groove is formed in a part of the discharge roller 68 in the sheet detection mechanism described in connection with the first exemplary embodiment will be described in detail. Since the second exemplary embodiment is identical with the first exemplary embodiment with regard to the print process, and hence explanations of the print process are omitted here. Elements analogous to those described in connection with the first exemplary embodiment are described with the same reference numerals.

Figure 6:
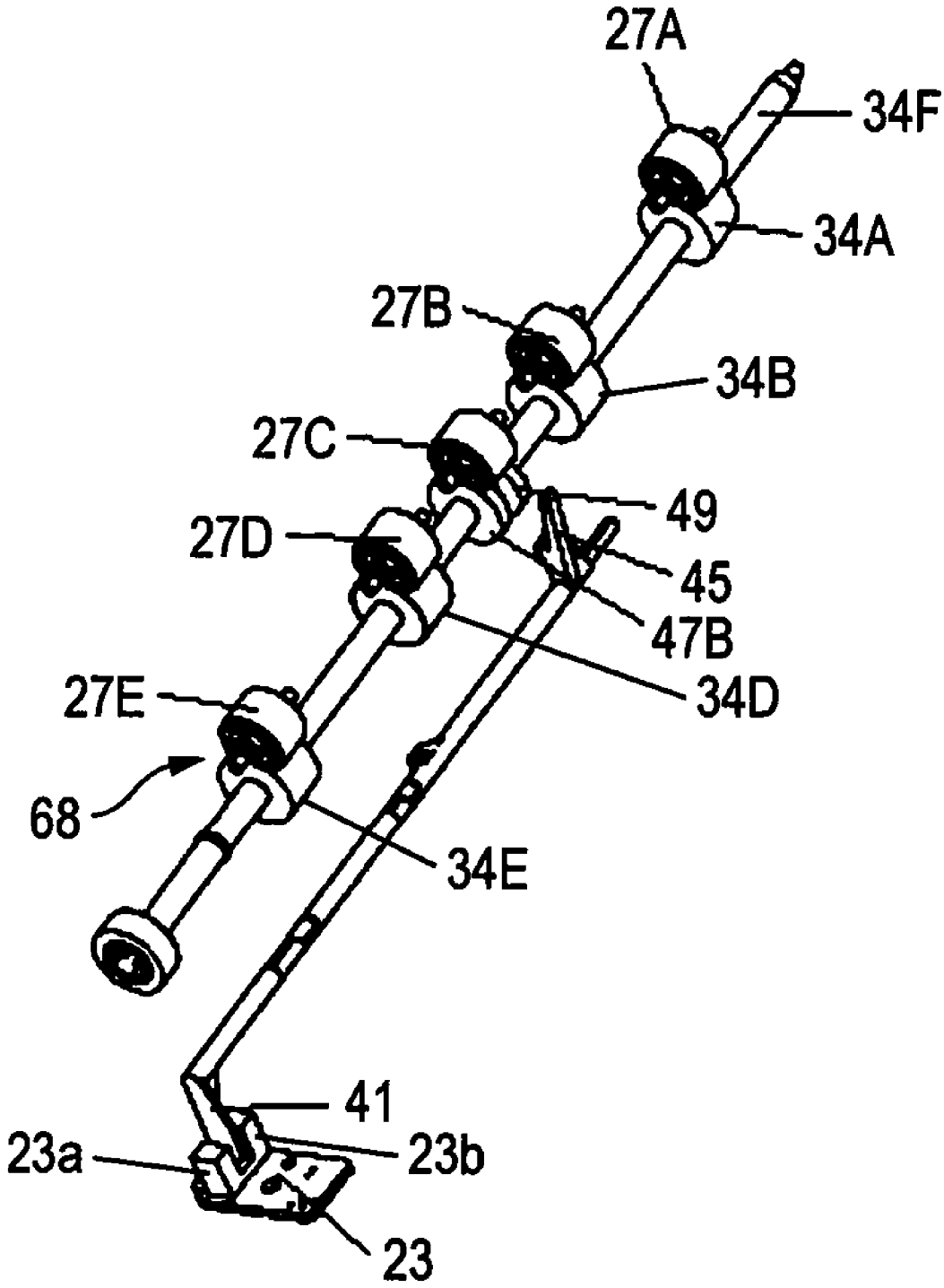
FIG. 6 is a perspective view of the actuator 25 and the discharge roller 68 of a second embodiment.

FIG. 6 is a perspective view of the actuator 25 and the discharge roller 68. In the drawings, the discharge roller 68 has a groove section 49, which extends in the circumferential direction, in the outer periphery of a center roller 47B. The actuator 25 is configured in such a way that, when the front end of the sheet 1 contacts the actuator 25 after the sheet 1 has been fixed and conveyed, the leading end of the projecting section 45 enters the groove section 49 of the center roller 47B.

Figure 7A:
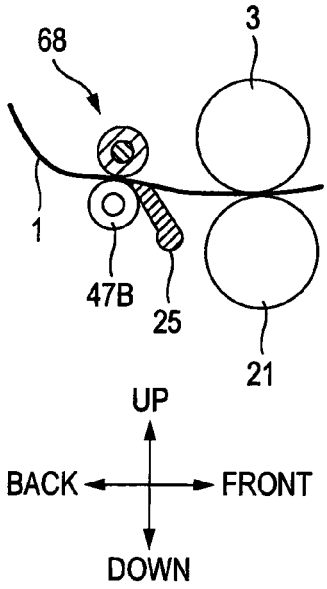
FIG. 7A is a view of the center cross-sectional view of the thermal fixing section 12.
Figure 7B:
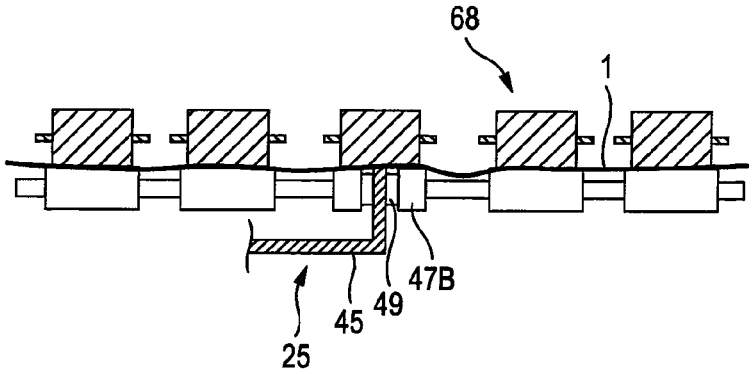
FIG. 7B is a schematic view showing the discharge roller 68, and the actuator 25 when viewed from the front of FIG. 7A.

FIG. 7A is a schematic view of the center cross-sectional view of the thermal fixing section 12, and FIG. 7B is a schematic view showing the discharge roller 68 and the actuator 25 when viewed from the front of FIG. 7A. In addition to the actuator 25 being arranged within the width of the center roller 47B, the groove section 49 is formed in the center roller 47B, and the diameter of the center roller 47B is reduced. When the sheet 1 is discharged from the position between the heating roller 3 and the pressure roller 21, the front end of the sheet 1 contacts the projecting section 45 of the actuator 25, whereupon the actuator 25 rotates counterclockwise.

Since the leading end of the projecting section 45 enters the groove section 49 formed in the center roller 47B at this time, the leading end does not contact the center roller 47B even when the actuator 25 is rotated. Further, deflections in the sheet 1 nipped between the upper discharge roller 27C and the center roller 47B are corrected by the groove section 49.

In addition to yielding the advantage of the ability to well detect the trailing end of the sheet 1 described in connection with the first exemplary embodiment, the configuration also enables positioning of the discharge roller 68 at a rear position by an amount corresponding to a reduction in the diameter resultant from formation of the groove section 49 in the center roller 47B, which in turn contributes to miniaturization of the overall laser printer 5.

In the second exemplary embodiment, the groove section 49 is formed in one center roller 47B; however, the center roller 47B may also be split into two pieces and separated from each other at an interval, to thus create the groove section 49.

Third Exemplary Embodiment

[Sheet Detection Mechanism for Use in Double-Sided Printing]

The third exemplary embodiment of the present invention achieved during double-sided printing is described in detail as an additional modification. In addition to the conveyance path for the sheet 1 employed during single-sided conveyance described in connection with the first exemplary embodiment or the second exemplary embodiment, a conveyance path 39 for double-sided printing purpose is provided beneath the housing 7 of the laser printer 5 shown in FIG. 1. In the case of double-sided printing, sheet 1 is first conveyed to the feed roller 28 through the print process described in connection with the first exemplary embodiment. The sheet 1 is again returned to the inside of the housing 7 as a result of reverse rotation of the feed roller 28. The thus-returned sheet 1 is conveyed to the double-sided printing conveyance path 39, by means of elastic force of the sheet 1, without returning to the conveyance path for single-sided printing.

The thus-conveyed sheet 1 is again conveyed to the image forming section 11 with a surface opposite to that achieved during single-sided printing facing upward. An image is generated as a result of the sheet 1 passing through a process analogous to that employed during single-sided printing, and the sheet is conveyed downstream and ejected to the outside of the housing 7.

In order to convey the sheet to the conveyance path for double-sided printing purpose without fail during conveyance of a sheet for double-sided printing shown in FIG. 1, the trailing end of the sheet 1 must be ejected fully from the discharge roller 68. Consequently, a mechanism for detecting discharge of the sheet from the discharge roller 68 without fail is required.

Figure 8:
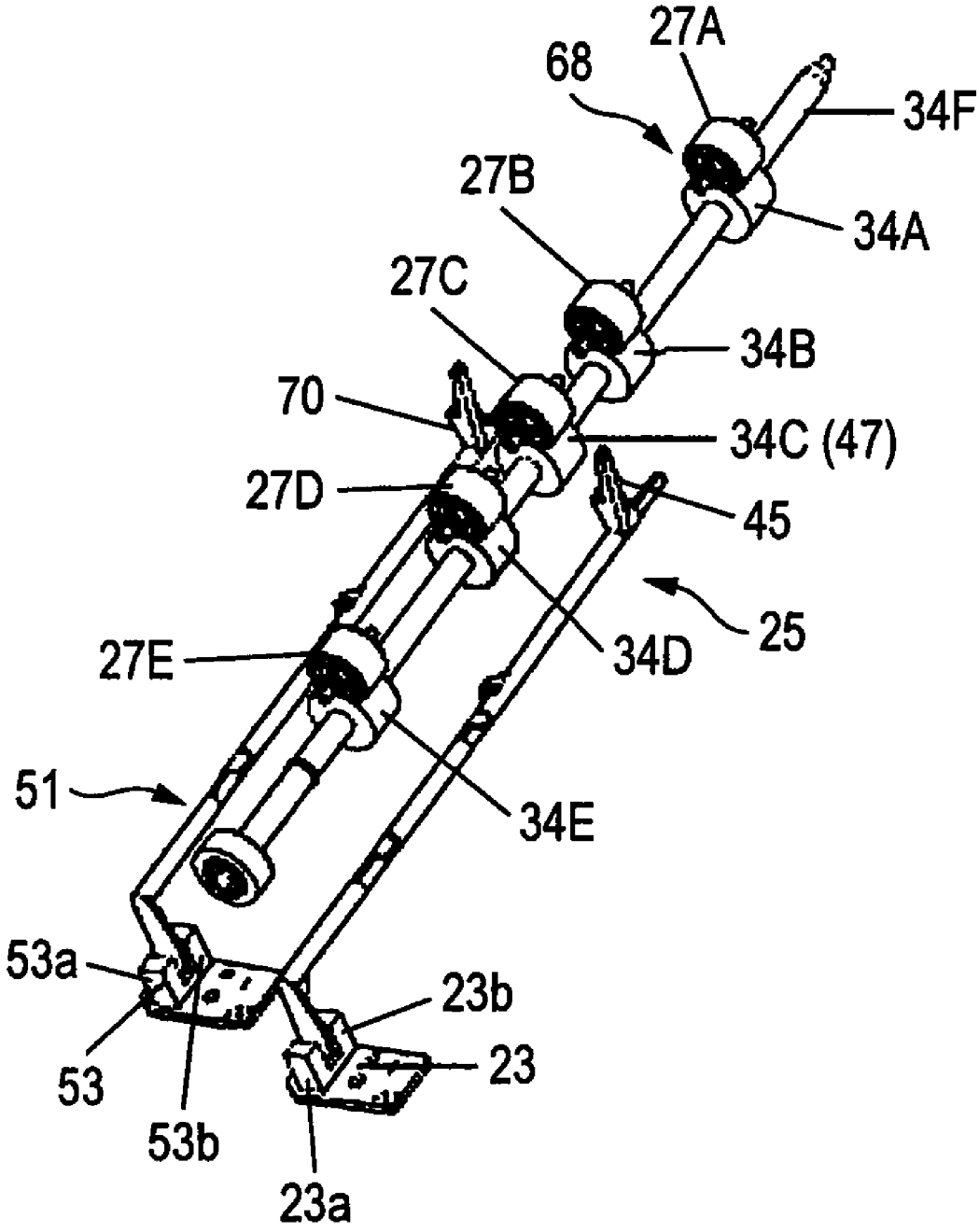
FIG. 8 is a perspective view of the actuator and the discharge roller 68 of a third embodiment.

FIG. 8 is a perspective view of the actuator and the discharge roller 68. In addition to the actuator 25 provided in the first exemplary embodiment, a second actuator 51 serving as an actuator of a second detection unit of the present invention and a second sensor section 53 are provided. The second sensor section has a light-emission portion 53*a* and a light receiving portion 53*b*. The second actuator 51 is analogous in shape to the actuator 25 and rotatably provided on the casing 30. A projecting section 70 is provided within the width of the center roller 47 and in a sheet conveyance path downstream from the discharge roller 68. Further, the second sensor section 53 is provided on the housing 7, and a method for detecting the sheet 1 is analogous to that described in connection with the first exemplary embodiment.

In the configuration, when the sheet 1 is discharged from the discharge roller 68, the leading end of the projecting section 70 of the second actuator 51 contacts the area of the sheet 1 whose deflections have been corrected by means of nipping action of the discharge roller 68. Consequently, the second actuator 51 can detect the trailing end of the sheet 1 discharged from the discharge roller 68 at the position where the deflections in the sheet 1 have been corrected.

Figure 9:
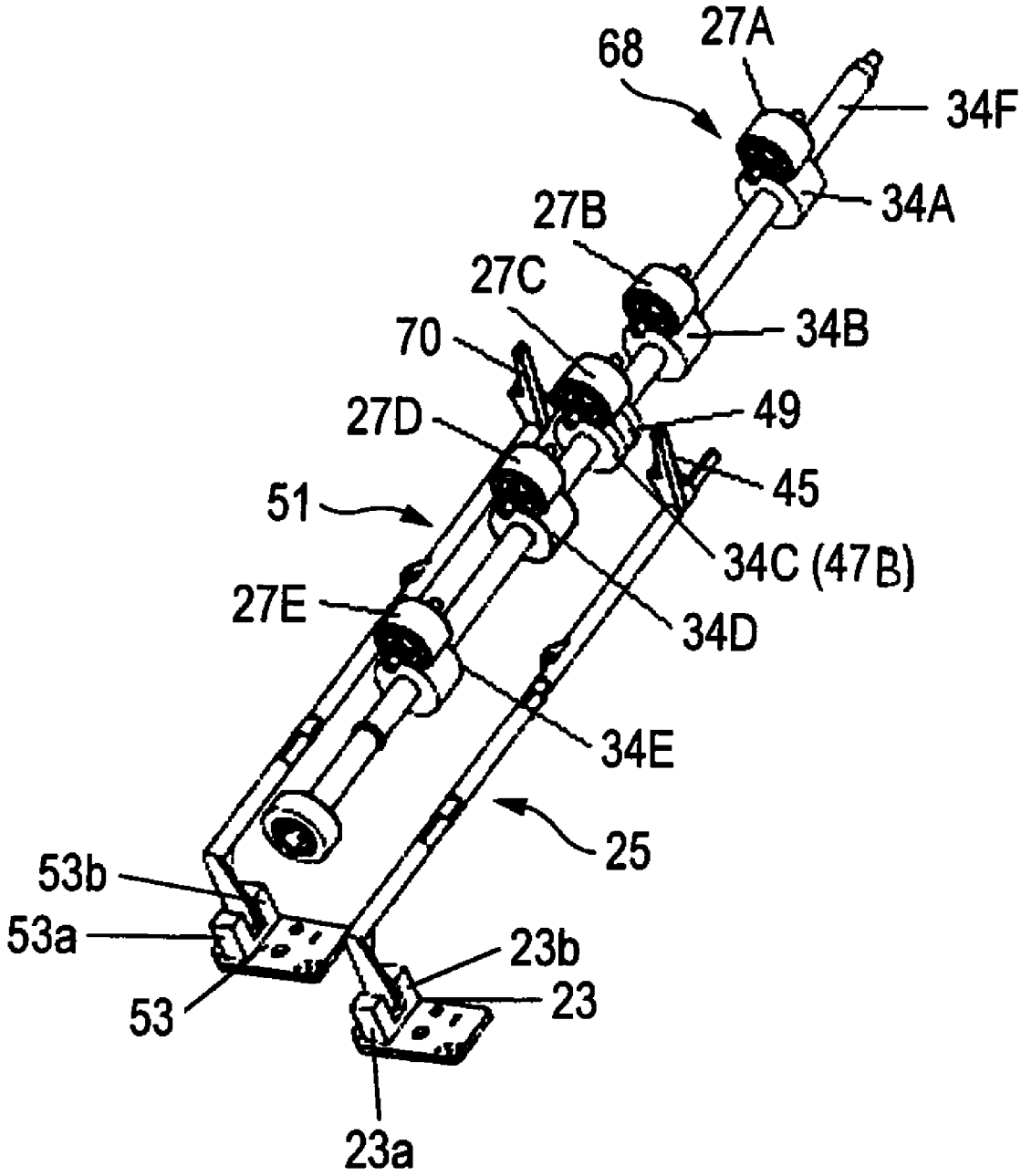
FIG. 9 is a perspective view of the actuator 25 and the discharge roller 68 with a groove section 49 provided in a center roller 47.
Figure 10A:
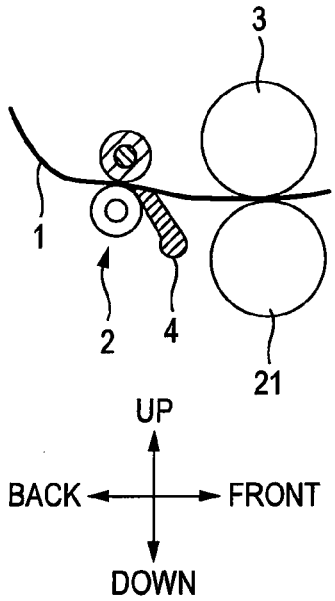
FIG. 10A is a diagrammatic view of a related-art sheet detection mechanism.
Figure 10B:
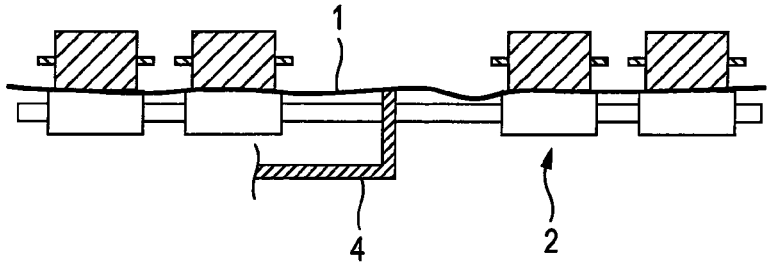
FIG. 10B is a diagrammatic view of the related-art sheet detection mechanism when viewed from the back in FIG. 10A.

A combination of the third exemplary embodiment with the second exemplary embodiment is also possible as another modification. FIG. 9 is a perspective view of the actuator 25 and the discharge roller 68. In the drawing, the groove section 49 is provided in the center roller 47B. By means of such a configuration, miniaturization as well as superior detection of a trailing end of a sheet can be realized. As a matter of course, even a laser printer not having a double-sided print mechanism may also be provided with a second detection unit, to thus be configured so as to enable more reliable detection of ejection of a sheet.

As mentioned above, in the third exemplary embodiment, deflections in the sheet 1 to be discharged are corrected, and a trailing end of a sheet can be detected properly. The present invention is not limited to the above described exemplary embodiments and is susceptible to modifications without departing the range of the gist of the present invention. For instance, the detection unit may also be of another type, so long as the unit has a mechanism capable of detecting ejection of a sheet, and the groove section 49 may also be provided in either one of the pair of vertically-arranged discharge rollers.

Depending on specifications of the image forming apparatus, a sheet is discharged while aligned to the right side or the left side rather than to the center. The projecting section 45 of the actuator 25 may also be provided within the width of the left-end or right-end lower discharge roller 34 in conformance with the specifications of the apparatus.

The projecting section 45 may also be provided in correspondence to each of the discharge roller 68, and the number of rollers is also not limited to the above described exemplary embodiments. For instance, the sheet 1 may also be nipped between respective single rollers in connection with the upper discharge roller 27 and the lower discharge roller 34.

As described above, an image forming apparatus according to one aspect of the present invention comprising: a fixing unit that is configured to fix a developing material on a sheet; a plurality of a pair of rollers that discharge the sheet conveyed from the fixing unit; and a sheet detection unit that detects the sheet conveyed from the fixing unit, the sheet detection unit comprising an actuator for detecting the sheet conveyed from the fixing unit, wherein the actuator of the sheet detection unit is disposed between the fixing unit and the plurality of the pair of rollers on a conveyance path and is disposed within a width of one of the rollers when viewed from a sheet conveyance direction.

Further, according to another aspect of the present invention, wherein the plurality of the pair of the rollers include a pair of center rollers that contact a center of the sheet discharged while aligned to a center, and the actuator is disposed on the conveyance path and is disposed within the width of one of the center rollers when viewed from the sheet conveyance direction.

Further, according to another aspect of the present invention, the plurality of the pair of the rollers include an opposed roller that is opposed to the actuator, and a groove section into which the actuator can enter is formed on an outer periphery of the opposed roller, the groove section extends in a circumferential direction of the opposed roller.

Further, according to another aspect of the present invention, the fixing unit is made up of a heating roller and a press roller, and that the actuator is disposed on the press roller side.

Further, according to another aspect of the present invention, the image forming apparatus, further comprising: a second detection unit that detects the sheet conveyed from the plurality of the pair of the rollers, the second detection unit comprising an actuator for detecting the sheet conveyed from the plurality of the pair of the rollers, and wherein the actuator of the second detection unit is disposed on a conveyance path downstream from the plurality of the pair of the rollers and is disposed within a width of one of the rollers when viewed from the sheet conveyance direction.

As is obvious from the above descriptions, the invention defined in one of the exemplary embodiments enables superior detection of a sheet.

One of the exemplary embodiments enables superior detection of; especially, a sheet to be conveyed while aligned to the center by arranging an actuator in a conveyance path within the width of the center roller.

The invention defined in one of the exemplary embodiments enables formation of a groove section in the discharge unit and positioning of the actuator in the groove section and a reduction in the distance between the actuator and the discharge unit, which in turn contributes to miniaturization of the image forming apparatus.

The invention defined in one of the exemplary embodiments enables superior detection of a sheet ejected from the heating roller.

The invention defined in one exemplary embodiments enables superior detection of; particularly, a sheet ejected from the discharge unit during double-sided printing by providing an actuator of the second detection unit, on the conveyance path within the width of the discharge unit, downstream from the discharge unit.

What is claimed is:

1. An image forming apparatus comprising:

a fixing unit that is configured to fix a developing material on a sheet;

a plurality of pairs of rollers configured to discharge the sheet conveyed from the fixing unit; and a sheet detection unit configured to detect the sheet conveyed from the fixing unit, the sheet detection unit comprising an actuator which moves in response to contact from the sheet conveyed for detecting the sheet conveyed from the fixing unit, wherein the actuator of the sheet detection unit is disposed between the fixing unit and the plurality of the pairs of rollers on a conveyance path and is disposed within a width of one of the rollers when viewed from a sheet conveyance direction, wherein the plurality of the pairs of rollers are provided in a same position in the sheet conveyance direction, wherein the plurality of the pairs of the rollers include an opposed roller that is opposed to the actuator, and wherein a groove section into which the actuator enters in response to contact from the sheet conveyed is formed on an outer periphery of the opposed roller, the groove section extending in a circumferential direction of the opposed roller.

2. The image forming apparatus according to claim 1, wherein the plurality of the pairs of the rollers include a pair of center rollers that is configured to contact a center of the sheet discharged while aligned to a center, and the actuator is disposed on the conveyance path and is disposed within a width of one of the center rollers when viewed from the sheet conveyance direction.

3. The image forming apparatus according to claim 1, wherein the fixing unit comprises a heating roller and a press roller, and the actuator is disposed closer to the press roller than the heating roller.

4. The image forming apparatus according to claim 1, further comprising:

a second detection unit configured to detect the sheet conveyed from the plurality of the pairs of the rollers, the second detection unit comprising an actuator for detecting the sheet conveyed from the plurality of the pairs of the rollers, and wherein the actuator of the second detection unit is disposed on a conveyance path downstream from the plurality of the pairs of the rollers and is disposed within a width of one of the rollers when viewed from the sheet conveyance direction.

5. The image forming apparatus according to claim 1, wherein the plurality of the pairs of rollers are included in a discharge roller, wherein the actuator of the sheet detection unit is disposed within a width of one of the rollers of the discharge roller when viewed from the sheet conveyance direction.

6. An image forming apparatus comprising:

a fixing roller for fixing a developing material on a sheet;

a discharging roller that includes a plurality of pairs of rollers that is disposed at a downstream side in a sheet conveyance direction than the fixing roller and is configured to discharge the sheet; and a sheet detection unit that comprises:

a sensor unit that has a light-emission portion and a light receiving portion; and an actuator unit that has a shaft disposed between the fixing roller and the discharge roller, a projecting portion protruding from a first portion of the shaft, and a light-shielding portion protruding from a second portion opposite to the first portion in an axial direction of the shaft, wherein the projection portion is disposed between the fixing roller and the discharge roller and is disposed within a width of one of the rollers of the discharge roller when viewed from the sheet conveyance direction, wherein when the projection portion does not contact the sheet conveyed from the fixing roller, the light-shielding portion is located at a position between the light-emission portion and the light-shielding portion, and when the projection portion contacts the sheet conveyed from the fixing roller, the shaft rotates so that the light-shielding portion is located outside of the position, wherein the plurality of the pairs of the rollers include an opposed roller that is opposed to the projection portion, and wherein a groove section into which the projection portion enters in response to contact from the sheet conveyed is formed on an outer periphery of the opposed roller, the groove section extending in a circumferential direction of the opposed roller.

* * * * *